United States Patent [19]

Wandler

[11] 4,108,530

[45] Aug. 22, 1978

[54] FEMALE TERMINAL AND METHOD OF MAKING SUCH

[75] Inventor: Richard A. Wandler, Clinton, Iowa

[73] Assignee: General Electric Company, Fort Wayne, Ind.

[21] Appl. No.: 645,044

[22] Filed: Dec. 29, 1975

[51] Int. Cl.[2] ..... H01R 13/12

[52] U.S. Cl. ..... 339/256 SP

[58] Field of Search ..... 339/95, 191–194, 339/223, 252, 253, 256, 258

[56] References Cited

U.S. PATENT DOCUMENTS

| | | | |
|---|---|---|---|
| 1,603,679 | 10/1926 | Gagnon | 339/256 R |
| 2,648,827 | 8/1953 | Knollman | 339/256 |
| 2,760,173 | 8/1956 | Cunningham | 339/76 |
| 3,341,805 | 9/1967 | De Vito | 339/111 |
| 3,404,368 | 10/1968 | Roberts et al. | 339/223 |
| 3,543,227 | 11/1970 | Moulin | 339/256 R |
| 3,577,118 | 5/1971 | Reider | 339/258 R |
| 3,790,917 | 2/1974 | Ray | 339/95 R |
| 3,850,496 | 11/1974 | Hague | 339/64 M |
| 3,917,377 | 11/1975 | Hall et al. | 339/192 R L |

FOREIGN PATENT DOCUMENTS

| | | | |
|---|---|---|---|
| 292,321 | 6/1928 | United Kingdom | 339/258 R |

*Primary Examiner*—Joseph H. McGlynn
*Attorney, Agent, or Firm*—Joseph E. Papin

[57] ABSTRACT

A female terminal for receiving in electrical contacting engagement a spade portion having a generally rectangular cross-section of a male terminal. A strip of electrical material has a first portion, and a generally cylindric section is provided on the strip integral with the first portion and defining at least in part a bore for the electrical contacting engagement with the spade portion of the male terminal. The first portion and cylindric section respectively including means disposed generally in dovetailing relation with each other and defining at least a part of the bore for effecting constant electrical contact between the bore and the spade portion of the male terminal irrespective of any diametral position in which the spade portion may be received across the bore.

A method of making a female terminal is also disclosed.

21 Claims, 10 Drawing Figures

FEMALE TERMINAL AND METHOD OF MAKING SUCH

FIELD OF THE INVENTION

This invention relates generally to electrical connectors of the quick connect or disconnect type and in particular to a female terminal.

In the past, various types of female terminals have been provided for receiving in electrical contacting engagement male terminals, and the electrical contacting part of such female terminals have been afforded various shapes and various schemes for receiving and releasably retaining in frictional engagement such male terminals.

The past quick connect or quick disconnect female terminals were provided with a generally annular or cylindric section having a bore therein for receiving a male terminal in inteference or frictional engagement to effect electrical contacting engagement therebetween; and generally, the cylindric section of these past female terminals was split generally longitudinally of the bore thereof. In some of such past female terminals, the split ends of the cylindric section thereof were disposed in abutting or end-to-end relation; however, one of the disadvantageous or undesirable features of this particular type of female terminal is believed to be that it was necessary to closely control the tolerances of both the bore and a spade type male terminal inserted generally diametrally into the bore in order to prevent displacement opening of the abutted split ends of the cylindric section. Of course, such close tolerance control is believed to have adversely affected costs of making this particular type of female terminal as well as the spade type male terminal therefor. Further, the aforementioned spreading or opening of the abutted split ends is believed to have adversely affected the integrity of the electrical contacting engagement of the male terminal spade if it was diametrally positioned in the bore of the cylindric section generally at the spread or opening between the abutted split ends thereof. In some of these past terminals, reinforcing bands or such similar means were provided about the cylindric sections to prevent the spread or opening of the abutted split ends thereof, but it is believed that the cost involved in this particular scheme resulted in disadvantages which might outweigh the end result thereof.

In another of the past female terminals, the split ends of the cylindric section were supported generally against separation by a plurality of bands lanced from the cylindrical section generally opposite the split ends and depressed into the bores of the cylindric section so as to extend generally crosswise over the split ends. These bands were fused in place to the bore of the cylindric section. While these fused bands may have strengthened the cylindrical section to prevent opening of the split ends, it is believed that at least one of the disadvantageous features of this scheme was that it adversely affected the cost of making and was rather complicated for efficient manufacture.

SUMMARY OF THE INVENTION

Among the several objects of the present invention may be noted the provision of a female terminal which overcomes the disadvantageous or undesirable features discussed hereinabove, as well as others, with respect to the prior art; the provision of such female terminal which generally insures constant electrical contact with a male terminal; the provision of such female terminal in which a bore is provided in such female terminal having a generally continuous circumferential portion for effecting constant electrical contacting engagement with the male terminal spade portion inserted diametrally thereinto; and the provision of such female terminal which is simplistic in design and economical in manufacture. These as well as other objects and advantageous features of the present invention will be in part apparent and in part pointed out hereinafter.

In general and in one form of the invention, a female terminal is provided for receiving in electrical contacting engagement a male terminal with the spade portion having a generally rectangular cross-section. The female terminal has a body of electrical conductive material with a distal portion integral with another portion thereof and an end edge on the distal portion. The distal portion comprises a generally cylindric section with the end edge disposed at least closely adjacent the another portion so as to define in part a bore for the electrical contacting engagement with the male terminal. Means on one of the cylindric section and the another portion is provided for bridging between the end edge and the another portion so as to define at least a generally continuous circumferential section in the bore.

BRIEF DESCRIPTION OF THE DRAWINGS

Corresponding reference characters indicate corresponding parts throughout the several views of the drawings.

The exemplifications set out herein illustrate the preferred embodiments of the invention in one form thereof, and such exemplifications are not to be construed as limiting the scope of the invention in any manner.

DETAILED DESCRIPTION OF THE PREFERRED EMBODIMENTS

Figure 1:
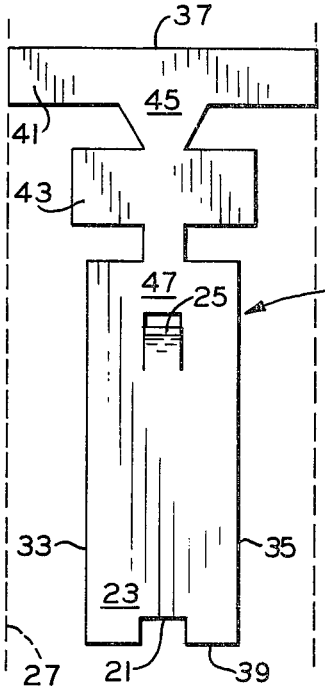
FIG. 1 is a plan view of a female terminal in one form of the invention in an early stage of its manufacture blanked from a strip of electrical conductive material and teaching at least in part principles of a method of making such female terminal.
Figure 2:
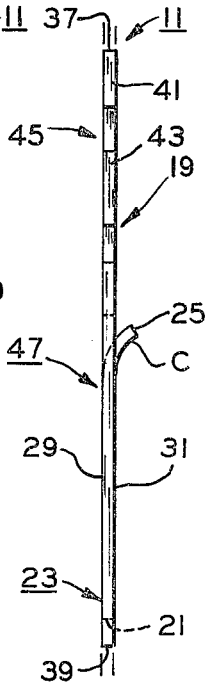
FIG. 2 is a side elevational view of the female terminal blank of FIG. 1.
Figure 3:
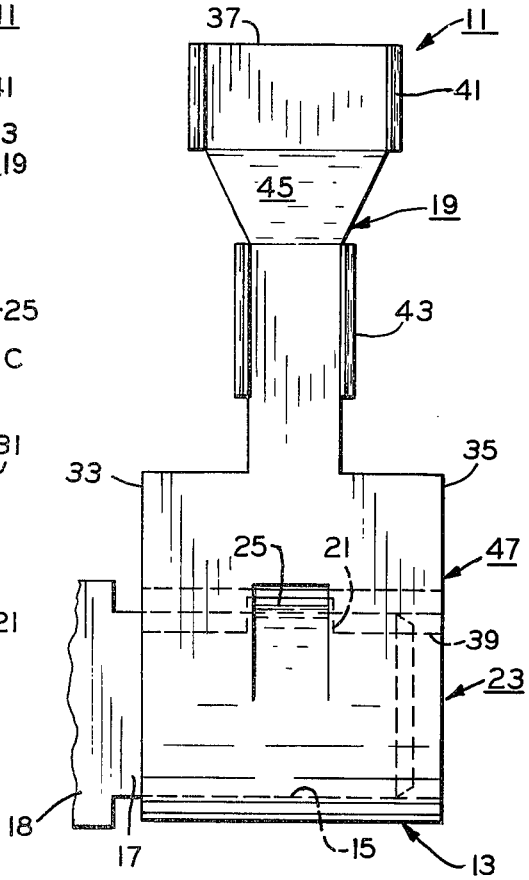
FIGS. 3 and 4 are enlarged plan and side elevational views illustrating the female terminal in its completed stage of manufacture and further teaching principles of the aforementioned method of making the female terminal.
Figure 4:
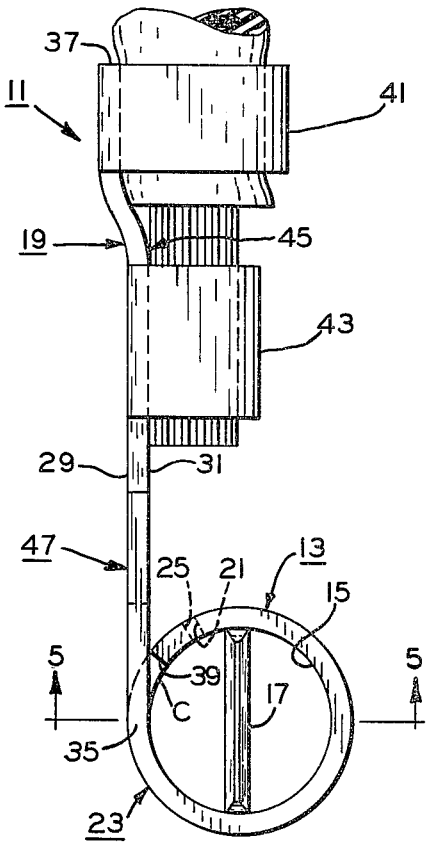
Figure 5:
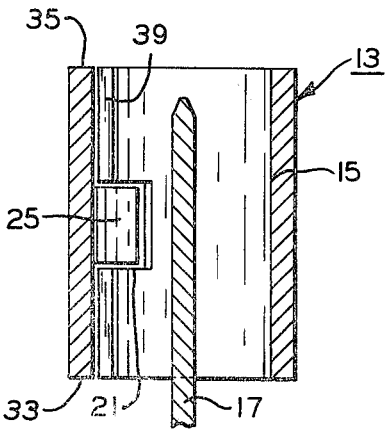
FIG. 5 is a sectional view taken generally along line 5—5 of FIG. 4.
Figure 6:
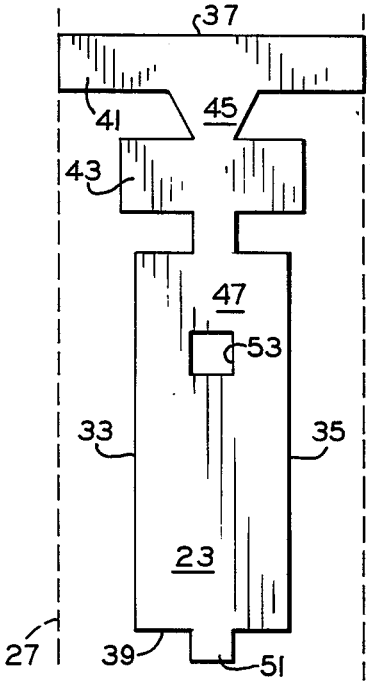
FIG. 6 is a plan view of an alternative female terminal in one form of the invention in an early stage of its manufacture blanked from a strip of electrical conductive material and teaching principles of an alternative method of making such female terminal also.
Figure 7:
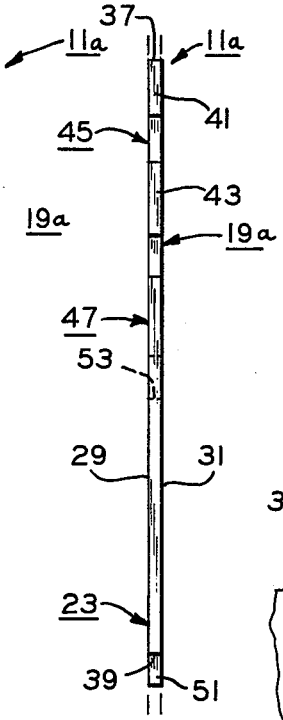
FIG. 7 is a side elevational view of the female terminal blank of FIG. 6.

Referring now to FIGS. 1–5 in general, there is shown in one form of the invention a method of making or manufacturing a quick connect (or disconnect) electrical female terminal 11 (FIGS. 1–5 having a generally annular or cylindric section 13 with an opening or bore 15 therethrough (FIGS. 3–5) adapted for receiving in electrical connection a spade portion 17 having a generally rectangular cross-section of a male terminal 18 (FIGS. 3 and 4). In this method, a strip or body 19 of electrical conductive material is blanked with an opening, such as a notch or slot 21, in a distal portion 23 thereof and a lanced tab or tongue 25 having a preselected curvature C extending from the strip (FIGS. 1 and 2), and the distal portion of the strip is deformed into cylindric section 13 having generally the same preselected curvature as the tab with the tab disposed at least in part within notch 21 (FIGS. 3–5).

More particularly and with specific reference to FIGS. 1 and 2, strip or female terminal body 19 may be stamped, punched or otherwise formed from a continuous electrical conductive strip material, as indicated in phantom lines at 27, in any suitable manner, such as for instance by the use of progressive dies, but for the sake of brevity and simplicity of disclosure, such progressive dies are omitted. Strip 19 is generally thin and planar having a pair of opposite faces 29, 31 intersecting wih a pair of opposite sides 33, 35, and a pair of opposite free ends or end portions, such as end edges 37, 39, intersect between the opposite faces and the opposite sides.

During a blanking step or operation of the aforementioned making method, oppositely extending, stepped pairs of lead connection arms 41, 43 are integrally formed generally in another or upper distal portion 45 of strip 19 opposite lower distal portion 23 thereof. At this time, tab 25 may also be lanced from an intermediate portion 47 of strip 19 disposed between opposite or distal portions 23, 45, and the tab is bent or otherwise displaced from the plane of the strip through face 31 thereof. It may be noted that at least a portion of tab 25 is provided with preselected curvature C, i.e., a curvature having a preselected radius, which corresponds with that of cylindric section 13, as discussed in greater detail hereinafter. To complete the blanking step, notch 21 is formed in distal portion 23 of strip 19 through end edge 39 thereof intersecting opposite strip faces 29, 31, and it may be noted that the notch is predeterminately sized to accommodate or receive tab 25, as also discussed hereinafter.

During a deforming step of this aforementioned making method, lower distal portion 23 of strip 19 is rolled or otherwise deformed into cylindric section 13 which has, as previously mentioned, generally the same preselected curvature C as tab 25, as seen in FIGS. 3–5, and the cylindric section is disposed at least in part in spaced overlaying relation with intermediate portion 47 of the strip. Upon such rolling of cylindric section 13, end edge 39 of strip 19 is moved into a position at least adjacent opposite face 31 generally at intermediate portion 47 of the strip and extends therealong between opposite sides 33, 35. With cylindric section 13 so formed, it may be noted that opposite face 31 of strip 19 defines at least in part bore 15 within the cylindric section extending between opposite sides 33, 35 of strip 19. Further, upon the rolling of cylindric section 13, as discussed above, it may be noted that notch 21 is moved into a generally dovetailing position or relation accommodating or receiving tab 25 therein so that the tab extends at least in part generally circumferentially with respect to the cylindric section and coextensively therewith, and it may also be noted that the tab bridges or extends across a space between end edge 39 adjacent opposite face 31 so as to define a part of bore 15 within the cylindric section. At any time during the formation of strip 19, lead connecting arms 41, 43 may be folded from their blanked-out, generally planar form, as shown in FIGS. 1 and 2, to a position extending generally perpendicular to upper distal portion 45 of strip 19, as shown in FIGS. 3 and 4.

With reference to FIGS. 6–10, there is shown an alternative method for making a female terminal **11*a*. This alternative method includes generally the same steps and female terminal 11*a* has generally the same components as the above-discussed making method and female terminal 11 with the exceptions set out hereinafter. While the alternative making method and female terminal 11*a* meet at least some of the objects and advantageous features discussed hereinbefore with respect to the above-discussed making method and female terminal 11, it may be noted that such alternative making method and female terminal 11*a*** may also have additional advantageous features of their own as will be in part apparent and in part pointed out hereinafter.

With respect to the alternative method of making female terminal **11*a*, strip or body 19*a* thereof is formed or blanked with a tab or extension 51 protruding from end edge 39 of distal portion 23 of the strip, and an opening, such as a notch or slot 53, is provided through intermediate portion 47 of the strip. During the deforming step, distal portion 23 of strip 19*a* is rolled or otherwise deformed into cylindric section 13 with at least a part of tab 51 extending generally into dovetailing relation with opening 53 which accommodates or receives the tab. It may be noted that tab 51 has generally the same curvature C, i.e., generally the same radius, as bore 15 of cylindric section 13, and the tab bridges across a space defined between at least a part of end edge 39 in its position disposed closely adjacent opposite face 31 at intermediate portion 47 of strip 19*a*. In this manner, tab 51 defines or forms at least a part of bore 15 being generally coextensive therewith, and the tab extends generally circumferentially of cylindric section 13 defining with a part of the bore a generally continuous circumferential portion therein for electrical contacting engagement with spade portion 17 of male terminal 18**.

Referring again in general to the drawings and recapitulating at least in part with respect to the foregoing, there is shown in one form of the invention female terminal **11, 11*a* for receiving in electrical contacting engagement spade portion 17 having a generally rectangular cross-section of a male terminal 18. Female terminal 11, 11*a* includes strip or body 19, 19*a* of electrical material having a first or intermediate portion 47, and cylindric section 13 is provided on the strip integral with the intermediate portion and defining at least in part bore 15 for the electrical contacting engagement with spade portion 17 of male terminal 18. Intermediate portion 47 and cylindric section 13 respectively include means, such as tab 25 and tab 51, disposed generally in dovetailing relation with opening 21 and opening 53 for bridging between end edge 39 and intermediate portion 47 and defining at least a part of the bore for effecting constant electrical contact between the bore and spade portion 17 of male terminal 18** irrespective of any diametral position in which the spade portion may be received across the bore.

More particularly and with specific reference to FIGS. 3–5, it may be noted that tab 25 extends generally circumferentially of cylindric section 13 into dovetailing relation with slot 21 to define at least a part of bore 15 with the bore and tab having generally the same curvature or radius. In this manner, tab 25 defines with bore 15 a generally continuous circumferential section or portion within the bore which extends a predetermined distance generally across strip 19, and such continuous circumferential section serves to effect the aforementioned constant electrical contact and interferring fit or frictional engagement between the opposite contacts or sides on spade portion 17 of male terminal 18 when the spade portion is inserted into any diametral position across the bore within such continuous circumferential section thereof. While tab 25 and its complementary opening 21 are shown for purposes of disclosure, it is contemplated that a plurality of such tabs and openings may be provided in the aforementioned dovetailing relation bridging the space between end edge 39 and intermediate portion 47 of strip 19 within the scope of the invention so as to meet the objects and advantages thereof. Further, lead holding or electrical connecting means other than arms 41, 43 are contemplated for association with upper distal portion 45 within the scope of the invention.

Figure 8:
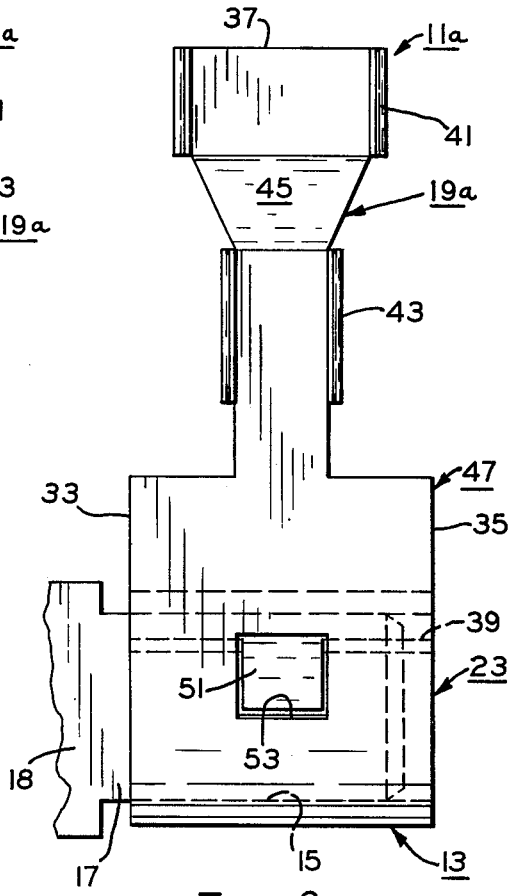
FIGS. 8 and 9 are enlarged plan and side elevational views illustrating the alternative female terminal in its completed stage of manufacture and further teaching principles of the aforementioned alternative method of making the alternative female terminal.
Figure 9:
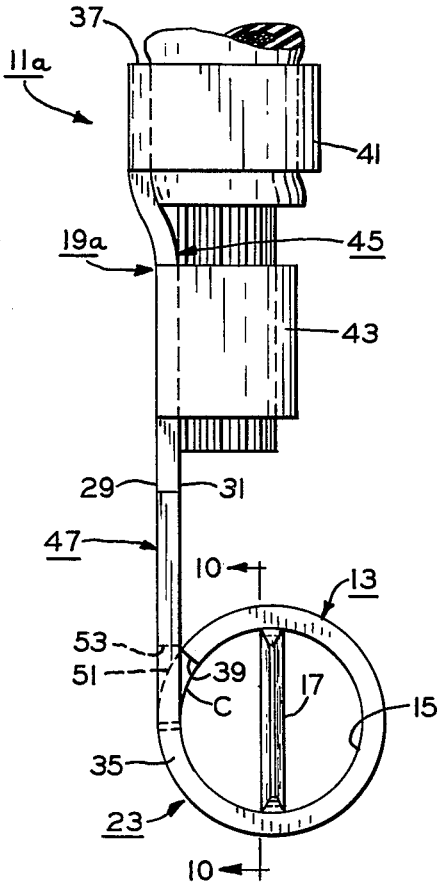
Figure 10:
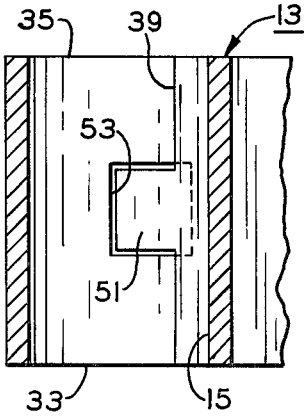
FIG. 10 is a sectional view taken generally along line 10—10 of FIG. 9.

In FIGS. 8–10, it may also be noted that tab 51 on cylindric section 13 extends generally circumferentially thereof into dovetailing relation with slot 53 of intermediate portion 47 to define at least part of bore 15 with the bore and tab having generally the same curvature or radius. In this manner, tab 51 defines with bore 15 a generally continuous circumferential section or portion within the bore which extends a predetermined distance lengthwise thereof generally across strip 19*a*, and such continuous circumferential section serves to effect the aforementioned constant electrical engagement between the opposite contacts or sides on spade 17 of male terminal 18 when the spade is inserted in any diametrally extending position across the bore within such continuous circumferential section. As previously mentioned with respect to female terminal 11, it is also contemplated that a plurality of tabs 51 and openings 53 may be provided in the dovetailing relation in female terminal 11*a* within the scope of the invention so as to bridge the space between end edge 39 and intermediate portion 47, and other lead holding or electrical connection means are contemplated for association with distal portion 45 other than arms 41, 43.

From the foregoing, it is now apparent that novel female terminals 11, 11*a* are provided meeting the objects and advantageous features set out herein as well as others, and it is contemplated that changes as to the precise configurations, shapes and details of the structures which are presented merely to illustrate the invention, may be made by those having ordinary skill in the art without departing from the spirit and scope of the invention as set out by the claims which follow.

What I claim as new and desire to secure by Letters Patent of the United States is:

1. A female terminal for receiving in electrical contacting engagement a pair of generally opposite contacts on a spade portion of a male terminal, the female terminal comprising a strip of electrical conductive material having a pair of opposite faces intersecting with a pair of opposite sides, at least one end edge of said strip respectively intersecting with said opposite faces and said opposite sides, a distal portion of said strip including said at least one end edge being displaced with respect to the rest of said strip so as to comprise a generally cylindric section with said at least one end edge being adjacent one of said opposite faces and extending generally in opposed relation therealong between said opposite sides, said one opposite face within said cylindric section defining in part a bore therethrough between said opposite sides, at least one slot in said at least one end edge and intersecting with said bore, and at least one tab integral with said strip and extending therefrom through said one opposite face into said at least one slot and generally circumferentially of said cylindric section to define a part of said bore, said tab and said cylindric section comprising means for effecting constant electrical contact between said bore and the opposite contacts of the spade portion irrespective of any generally diametral position in which the spade portion may be inserted across said bore.

2. The combination comprising a spade male terminal, a female terminal for receiving in electrical contacting engagement said spade male terminal in any diametral position thereof, said female terminal having a body of electrical conductive material with a distal portion integral with another portion, an end edge on said distal portion, said distal portion comprising a generally cylindric section with said end edge disposed at least adjacent said another portion so as to define at least in part a bore for the electrical contacting engagement with said spade male terminal, and means on one of said cylindric section and said another portion for bridging between said end edge and said another portion to define with said bore a generally continuous circumferential section therein so that said male terminal is received in the any diametral position thereof across said bore in the electrical contacting engagement therewith.

3. The combination as set forth in claim 2 further comprising an opening through one of said end edge and said another portion, and said bridging means including means on the other of said cylindric section and said another portion for extending at least in part into said opening so as to define with said bore the generally continuous circumferential section therein.

4. The combination as set forth in claim 2 further comprising at least one opening in said another portion, and said bridging means including at least one tab extending from said end edge into said at least one opening so as to define with said bore the generally continuous circumferential section therein.

5. The combination as set forth in claim 2 wherein said bridging means and said cylindric section have generally the same predetermined curvatures.

6. The combination as set forth in claim 2 wherein said cylindric section is disposed at least in part in laterally spaced and overlaying relation with said another portion.

7. The combination as set forth in claim 2 further comprising means associated with said another portion for electrical connection with an electrical lead.

8. A female terminal adapted for receiving in electrical contacting engagement a male terminal, the female terminal comprising a body of electrical conductive material having a distal portion integral with another portion, an end edge on said distal portion, said distal portion including a generally cylindric section with said end edge disposed at least closely adjacent said another portion so as to define in part a bore for the electrical contacting engagement with the male terminal, at least one opening in said cylindric section intersecting with both said end edge and said bore, and at least one tab extending from said another portion into said at least one opening so as to bridge between said end edge and said another portion and define at least a part of said bore.

9. The combination comprising a spade male terminal, a female terminal for receiving in electrical contacting engagement said spade male terminal in any diametral position thereof, said female terminal including a strip of electrical material having a first portion, a generally cylindric section on said strip integral with said first portion and having a preselected curvature so as to define at least in part a bore extending generally axially across said strip for the electrical contacting engagement with said spade male terminal, and said first portion and said cylindric section respectively including means for disposition generally in dovetailing relation with each other with one of said disposition means having a curvature generally complementary to that of said cylindric section to define with said bore a generally continuous circumferential section therein so that said male terminal is received in the any diametral position thereof across said bore in the electrical contacting engagement therewith.

10. The combination as set forth in claim 9 wherein the other of said disposition means comprises at least one opening in one of said first portion and said cylindric section.

11. The combination as set forth in claim 10 wherein said one disposition means comprises at least one tab on the other of said first portion and said cylindric section extending into the dovetailing relation with said at least one opening.

12. The combination as set forth in claim 9 wherein said cylindric portion comprises an end ege disposed at least adjacent said first portion, said one disposition means bridging between said end edge and said first portion.

13. The combination as set forth in claim 12 wherein the other of said disposition means comprises an opening in said cylindric section intersecting with said end edge and said bore, said one disposition means being received in said opening in the dovetailing relation therewith.

14. The combination as set forth in claim 13 wherein said one disposition means includes a tab on said first portion and extending therefrom into said opening.

15. The combination as set forth in claim 9 wherein the other of said disposition means comprises an opening in said first portion, said one disposition means being received in said opening in the dovetailing relation therewith.

16. The combination as set forth in claim 15 wherein said one disposition means includes a tab on said cylindric section and extending therefrom into said opening.

17. The combination comprising a spade male terminal, a female terminal for receiving in electrical contacting engagement said spade male terminal in any diametral position thereof, said female terminal including a strip of electrically conductive material having a pair of integral portions, one of said integral portions defining in part a bore having a preselected curvature and extending generally axially across said strip for the electrical contacting engagement with said spade male terminal, at least one opening through one of said one integral portion and the other of said integral portions, and at least one tab on the other of said one integral portion and said other integral portion having a curvature generally complementary to that of said bore and extending into said at least one opening to define with said bore a generally continuous circumferential section therein so that said male terminal is received in the any diametral position thereof across said bore in the electrical contacting engagement therewith.

18. The combination comprising a male terminal having a spade portion, a female terminal for receiving in electrical contacting engagement said spade portion of said male terminal in any diametral position thereof, said female terminal including a strip of electrical conductive material having a first portion integral with a distal portion with said distal portion defining at least in part a bore having a preselected curvature and extending generally axially across said strip, at least one notch extending through one of said first portion and said distal portion, and at least one tab having a curvature generally complementary to that of said bore and extending from the other of said first portion and said distal portion generally into said at least one notch so as to define with said bore means for effecting the electrical contacting engagement with said spade portion irrespective of the any diametral position in which said spade portion is received across said bore.

19. The combination as set forth in claim 18 wherein said distal portion includes an end edge disposed at least closely adjacent said first portion, said at least one notch extending into said end edge.

20. The combination as set forth in claim 18 wherein said strip includes an end edge integral with said distal portion and spaced adjacent said first portion, said at least one notch extending into said end edge, and said at least one tab bridging at least a part of the space between said end edge and said first portion.

21. The combination comprising a male terminal having a spade portion, a female terminal for receiving in electrical contacting engagement said spade portion of said male terminal in any diametral position thereof, said female terminal comprising a strip of electrical conductive material having an intermediate portion interposed between a pair of generally opposite portions, one of said opposite portions including means for electrical connection with an electrical lead, the other of said opposite portions including a generally cylindric section extending generally crosswise of said strip, a bore within said cylindric section having a preselected curvature, an opening through one of said cylindric section and said intermediate portion, a free end portion on said cylindric section and having at least part of an edge thereof spaced from said intermediate portion so as to interrupt said bore generally crosswise of said strip, and means for bridging the interruption in said bore so as to define with said bore a generally continuous circumferential section therein adapted to receive in the electrical contacting engagement said spade portion of said male terminal irrespective of the any diametral position in which the spade portion is received across said bore, said bridging means including means on the other of said cylindric section and said intermediate portion for extending across the interruption in said bore into said opening and having at least in part a curvature generally complementary to the preselected curvature of said bore.

* * * * *

UNITED STATES PATENT AND TRADEMARK OFFICE

CERTIFICATE OF CORRECTION

PATENT NO. : 4,108,530

DATED : August 22, 1978

INVENTOR(S) : Richard A. Wandler

It is certified that error appears in the above-identified patent and that said Letters Patent are hereby corrected as shown below:

Abstract, line 16, delete in its entirety.
Col. 1, line 2, delete "AND METHOD OF MAKING";
line 3, delete "SUCH";
line 68, delete "generally insures" and insert --insures generally--.
Col. 2, line 46, delete "also";
line 68, delete "in one form of the invention".
Col. 3, line 2, after "5" insert --)--.

Signed and Sealed this

*Sixth* Day of *November 1979*

[SEAL]

*Attest:*

RUTH C. MASON
*Attesting Officer*

LUTRELLE F. PARKER
*Acting Commissioner of Patents and Trademarks*